US008156951B2

(12) United States Patent
Klose

(10) Patent No.: US 8,156,951 B2
(45) Date of Patent: Apr. 17, 2012

(54) POCKET UMBRELLA COMPRISING A HANDLE COVER AND A SUPPORT FOR THE TELESCOPIC TUBE

(75) Inventor: Odo Klose, Wuppertal (DE)

(73) Assignee: Brain Promotion GmbH & Co. KG, Solingen (DE)

( * ) Notice: Subject to any disclaimer, the term of this patent is extended or adjusted under 35 U.S.C. 154(b) by 57 days.

(21) Appl. No.: 12/675,902

(22) PCT Filed: Sep. 1, 2008

(86) PCT No.: PCT/EP2008/007134

§ 371 (c)(1),
(2), (4) Date: Mar. 1, 2010

(87) PCT Pub. No.: WO2009/039939

PCT Pub. Date: Apr. 2, 2009

(65) Prior Publication Data

US 2010/0212706 A1 Aug. 26, 2010

(30) Foreign Application Priority Data

Sep. 2, 2007 (DE) ..... 20 2007 012 276

(51) Int. Cl.
*A45B 25/24* (2006.01)
*A45B 19/00* (2006.01)

(52) U.S. Cl. ..... 135/25.41; 135/25.1; 135/34.2

(58) Field of Classification Search ..... 135/15.1, 135/19, 19.5, 25.1, 24, 25.4, 25.41, 34.2
See application file for complete search history.

(56) References Cited

U.S. PATENT DOCUMENTS

| | | | | |
|---|---|---|---|---|
| 868,326 | A | 10/1907 | Casale | |
| 892,813 | A | 7/1908 | Dolles | |
| 3,678,949 | A * | 7/1972 | Weber | 135/25.3 |
| 3,851,657 | A * | 12/1974 | Weber | 135/25.4 |
| 3,890,990 | A * | 6/1975 | Schafer | 135/15.1 |
| 4,842,003 | A * | 6/1989 | Baldwin et al. | 135/19.5 |
| 4,962,779 | A * | 10/1990 | Meng | 135/16 |
| 6,095,388 | A * | 8/2000 | Neville, Sr. | 224/556 |
| 7,069,939 | B1 * | 7/2006 | Conde | 135/16 |
| 7,152,511 | B2 * | 12/2006 | Fen | 81/177.1 |

(Continued)

FOREIGN PATENT DOCUMENTS

AT 006 249 U1 6/2003

(Continued)

*Primary Examiner* — Winnie Yip
(74) *Attorney, Agent, or Firm* — Henry M. Feiereisen; Ursula B. Day

(57) ABSTRACT

Disclosed is a folding umbrella that has an additional functionality such as an umbrella cover, in particular a compact pocket umbrella comprising a handle cover and support for the telescopic tube. The aim of the invention is to design a folding pocket umbrella that has an additional functionality such as an umbrella cover, in particular a compact pocket umbrella comprising a handle cover and support for the telescopic tube. The preferably oval handle cover is designed in such a way as to be able to accommodate the entire umbrella when the umbrella that substantially comprises a stationary tube, a telescopic tube, a slide, canopy rods, and a canopy is folded and collapsed. In order for a user to be able to quickly manipulate the umbrella, an extractable handle is provided which is easy to access, preferably also has an oval shape, and is fixedly connected to the end of the telescopic tube.

13 Claims, 2 Drawing Sheets

U.S. PATENT DOCUMENTS 7,210,490 B2 * 5/2007 Ko ..... 135/24

FOREIGN PATENT DOCUMENTS

| | | | |
|---|---|---|---|
| DE | 618 174 | | 8/1935 |
| DE | 625 783 | | 2/1936 |
| DE | 1814 204 | | 9/1970 |
| DE | 2 137 261 | | 2/1973 |
| DE | 4008212 | A1 | 9/1991 |
| DE | 4314650 | A1 | 11/1994 |
| DE | 19505707 | C1 | 3/1996 |
| DE | 19525409 | A1 | 7/1996 |
| DE | 20119736 | U1 | 2/2002 |
| DE | 10253797 | A1 | 5/2004 |
| EP | 0 495 472 | A2 | 7/1992 |
| GB | 311265 | | 8/1929 |
| GB | 2320 893 | A | 7/1998 |
| JP | 2000070024 | A | 7/2000 |
| JP | 2002291509 | A | 10/2002 |
| WO | WO 97/48303 | | 12/1997 |
| WO | WO2005/013755 | | 2/2005 |

* cited by examiner

1

10

POCKET UMBRELLA COMPRISING A HANDLE COVER AND A SUPPORT FOR THE TELESCOPIC TUBE

CROSS-REFERENCES TO RELATED APPLICATIONS

This application is the U.S. National Stage of International Application No. PCT/EP2008/007134, filed Sep. 1, 2008, which designated the United States and has been published as International Publication No. WO 2009/039939 and which claims the priority of German Patent Application, Serial No. 20 2007 012 276.4, filed Sep. 2, 2007, pursuant to 35 U.S.C. 119(a)-(d).

BACKGROUND OF THE INVENTION

The invention relates to a collapsible umbrella comprising an additional further functionality of an umbrella cover, in particular a compact pocket umbrella comprising a handle cover and a support for the telescopic tube.

Due to the long history of umbrellas, an extensive and manifold collection of corresponding patent literature has accumulated. Everything related to a covering and collapsing was developed under the keyword "collapsible umbrella" or "fold-away umbrella" based on the application thereof. As an example, the following extensive field of corresponding applications can be found

- collapsible pocket umbrella comprising reinforced canopy rod frame
- fully automatic collapsible umbrella
- automatic umbrella
- collapsible clothesline umbrella
- mobile umbrella canopy for events
- wind-resistant collapsible umbrella
- easy-open and collapsible umbrella comprising reduced volume
- collapsible umbrella comprising city map
- suspension arrangement for collapsible umbrella
- chair comprising bracket and umbrella
- insect-protection umbrella
- bicycle comprising bracket and umbrella
- bracket comprising collapsible sun protection
- bracket and umbrella for strollers
- bracket and umbrella for animals
- canopy arrangement
- transport means, which can be collapsed and opened
- collapsible baby cart
- collapsible umbrella as broadband antenna.

The following will be limited to the functionality of the collapsible pocket umbrella, even though technical components, modules and approaches can also be found in the applications of closely related disciplines.

The state of the art of collapsible umbrellas comprising a further functionality, such as umbrella cover comprising umbrella handle and support for the telescopic tube will be evaluated below; depending on the application, a plurality of types of collapsible umbrellas comprising an additional further functionality, such as umbrella cover comprising an umbrella handle, are known from the state of the art.

German patent document DE 195 25 409 discloses a lockable and closable cylindrical plastic case as umbrella cover, which is developed for two-wheelers and in particular for the transport of the collapsed pocket umbrella without rocking motions and noises. The rigid cylinder box holding together the collapsed covering, which forms the umbrella canopy, is closed on one side by means of a circular bottom and encompasses a removable lid on the other side, which can be locked by means of a number/combination lock while being connected to a toothed rack and being retracted as well as thus holding the clamp-like frame mounting elements. A characteristic of the pocket umbrella is that, in its longitudinal extension including the umbrella handle, it must be smaller than the closed box.

German patent specification DE 195 05 707 relates to a collapsible umbrella, the covering of which is supported by star-shaped canopy rods, which are arranged around the umbrella shaft. The canopy rods are articulated in a pivotable manner on a crown, which can be displaced along the umbrella shaft and clamped to its upper end, and in the expanded state of the umbrella, they are supported by support rods, which are articulated to the canopy rods with one end and to a slide on the other end, with said slide also being capable of being displaced and locked along the umbrella shaft. The closing and shortening of the umbrella takes place by collapsing the canopy rods above the crown and by inserting the umbrella shaft between the collapsed canopy rods. The characteristic of the arrangement lies in that the canopy rods and the support rods are collapsed away from the user.

German patent document DE 102 53 797 represents an umbrella container comprising a drying function, the use of which is intended in a motor vehicle, wherein the umbrella accommodating container is connected to the interior heater of the vehicle or has its own heater comprising a controllable drying phase. On the one hand, the umbrella container, which is formed in a hollow cylindrical manner, is to accommodate a telescopic dry umbrella or, on the other hand, a wet telescoped umbrella for drying purposes. Ducts, which are vented by air, which is fed opposite to the umbrella retraction side and which ducts are to discharge the moisture of wet umbrella coverings, form between the cylindrical jacket of the container and the retracted umbrella by means of guide webs, which point inward in radial direction. Instead of longitudinal guide bars, provision is in the alternative also made for cross bars in response to an air feed from the side. Statements relating to the dimensioning with reference to climatic relations have not been made.

European document EP 495 472, German utility model DE 91 15 108 and DE 91 00 505 disclose a container comprising an integrated pocket umbrella, which can be accessed from the outside. A flat container tube is installed into the cover of a briefcase requiring little space and behind the interior trim. A flat, square pocket umbrella, which can be telescoped, is retracted into the rectangular tube so as to be capable of being disengaged. The handle of the umbrella is retained in the tube by means of a lock; after disengaging the lock, the umbrella is released outwardly by means of a spring unit, which is introduced into the center rod of the umbrella. Umbrella and container are dependent on one another only to a limited extent—with reference to their design.

German patent document DE 43 14 650 provides for a portable container comprising a sheath-shaped accommodation for additionally accommodating a pocket umbrella. So as to design all three objects, such as sheath-shaped accommodation, umbrella and/or container to have the smallest possible volume in response to non-use and so as to be able to carry or pocket them, respectively, lightly and easily, but, on the other hand, so as to also have them in hand ready for use in a likewise simple manner when in need of their use, it is proposed for the container to have the shape of a tote bag, which can be rolled up, or the shape of a backpack comprising a sheath-shaped accommodation at one end, which runs at right angles to the side edges of the tote back or of the backpack, respectively. In the instant case of the application, pocket umbrella and container are two independent arrangements.

English patent specification GB 311 265 also introduces an umbrella container in connection with a ladies' handbag in such a manner that the umbrella can be accommodated within the handbag in brackets, which are provided for this purpose.

German patent document DE 40 08 212 deals with a collapsible pocket umbrella comprising an umbrella covering, a frame, which can be collapsed and which opens the umbrella covering in the open state, and a handle comprising the characteristic that the frame consists of an extendable rod—a telescopic rod—, spiral wires for opening the umbrella covering and the handle consisting of a tubular sleeve for accommodating the central rod, the spiral wires and the umbrella covering. The spiral wires are guided at the outer edge of the umbrella covering by means of limiting tension threads which, together with the spiral wires, end in a manually operated winding device at the base of the accommodating sleeve. By activating the winding device, the spiral wires and tension threads, including the umbrella covering and telescopic rod, are pulled into the accommodating sleeve. No statements are made with reference to the dimensioning of the accommodating sleeve.

German patent DE 21 37 261 discloses an umbrella, which can be shorted and which has a flat cross sectional form in the collapsed state, at the headpiece of which, which encompasses two blades, eight telescoping canopy rods are articulated in slits, wherein two canopy rods emerge in each case at the transverse sides of the headpiece. At the auxiliary slide of said umbrella, which also encompasses two blades, the auxiliary rods are analogously articulated in slits. At the other end, said auxiliary rods are flexibly connected to the main rods, which are articulated on the main slide. A container for the umbrella, which can be shortened, is not provided.

According to German document DE 18 14 204, a pocket umbrella comprising a handle, which can be shortened, and an umbrella surface, which is reinforced by means of webs, which are arranged in a star-shaped manner, is introduced, wherein the webs consist of bendable tubes, the ends of which are closed, and the inner ends of which end in a central chamber, which is formed by an upper and a lower wall. Said chamber encompasses a displaceable air inlet valve and the multi-part umbrella shaft is screwed to the air inlet valve. An umbrella container is not introduced; the size of the collapsed umbrella is predetermined by the largest partial length of the umbrella shaft.

German patent specification DE 62 57 83 also encompasses an umbrella comprising an extendable telescope-like umbrella shaft, which can be retracted into the handle, and canopy rods. In the retracted state, said umbrella closes tightly and is supported in two points, when extended. An interior ventilation of the umbrella handle is not provided.

German patent DE 61 81 74 encompasses an umbrella, which can be shortened and which can be completely retracted into the umbrella handle, comprising a main rodding, which is supported in two points and in radial direction. The umbrella handle, however, is split into two parts so as to be capable of being screwed and is closed so as to be absolutely tight in the screwed-up state.

Austrian utility model AT 006 249 introduces a mini pocket umbrella, which is retracted into the umbrella handle as a hollow body so as to be closed and which can be transported effortlessly, mainly in jackets and trouser pockets. This pocket umbrella is ultra-light and extremely small. It can always be carried along in a bag. After being used, the umbrella is retracted again into its umbrella handle and is closed in a water-tight manner by means of the lid. Disadvantages of the this type of mini pocket umbrella are that the main rodding is supported in a single point in the base of the umbrella handle and that a used wet umbrella is retracted into the umbrella handle, which closes in a water-tight manner.

Contrary thereto, U.S. Pat. No. 892,813 shows a single point support of the main rodding in the handle, which is located in the base point or at the head of the container, depending on the expansion of the umbrella and on the position of the rodding.

U.S. Pat. No. 868,326 also shows a collapsible umbrella comprising an umbrella container, in the case of which the stability of the main rodding is also only available in a base point support of the handle/container.

Japanese patent document JP 2002 291 509 presents a collapsible pocket umbrella, which can be telescoped, comprising a water-tight housing and an aid for closing and opening the umbrella. A reserve container is also attached to the umbrella, in the event that water from a wet umbrella has accumulated in the housing. The housing furthermore has a screwable draining opening. In the closed state, umbrella knob and housing opening are screwed together tightly. The umbrella is removed from the housing so as to be used. The housing acts like a packaging. The umbrella rod is fixedly connected to the knob.

International application WO 1997/48 303 "Combined Umbrella Case and Handle" introduces a hollow-cylindrical umbrella handle, which is to be screwed to a lid, wherein the umbrella handle is tightly closed completely by means of the screw connection with the lid when being loaded with an umbrella and the screwed lid has a passage and a lock for the main rodding for the two-point support when in the state in which the umbrella is extended.

All of the afore-mentioned prior art publications are suitable only to a limited extent or even not at all for the specific use as a collapsible umbrella comprising an additional further functionality of an umbrella cover, in particular not for a compact pocket umbrella comprising a handle cover and a support for the telescopic tube.

SUMMARY OF THE INVENTION

The invention is thus based on the object of creating a collapsible umbrella comprising an additional further functionality of an umbrella cover, in particular a compact pocket umbrella comprising a handle cover and a support for the telescopic tube.

This object is solved according to the invention by a collapsible umbrella comprising an additional functionality, such as an umbrella cover, in particular a compact pocket umbrella comprising a handle cover and a support for the telescopic tube, wherein a support element, which stabilizes the umbrella and is preferably fixedly connected to the first tube section of a telescopic tube, preferably via a tube accommodation and which is formed as spatially two-dimensional tripod, ensures a preferably three-point support of a riser, which is preferably fixedly connected to the base plate of a handle cover via a riser sleeve and/or of the telescopic tube, which is arranged so as to be displaceable with the riser by means of handle cover sliders to the hollow-cylindrical inner wall handle cover. The dependent claims refer to advantageous embodiments. The goal is a design of a collapsible pocket umbrella comprising an additional further functionality of an umbrella cover, in particular of a compact pocket umbrella comprising a handle cover and a support for the telescopic tube. The handle cover, which is preferably shaped like an oval, is embodied in such a manner that it can completely accommodate the umbrella, substantially consisting of riser, telescopic tube, slide, canopy rodding and covering by means of collapsing and/or pushing together. A quick handling by the user is provided by means of a well-accessible and likewise oval-shaped extractable handle, which is subsequently fixedly connected to the telescopic tube.

The combination of telescopic tube, riser, slide and support element represents a further advantageous characteristic of the inventive novelty in that the support element provides stability to the arrangement by means of its tripod design and its tripod sliding support in each position of the extracted telescopic tube.

A further advantageous embodiment of the invention is provided in that a ventilation of the interior, which is filled with the canopy rodding and the covering is provided, and that an accumulation of moisture is prevented by means of the bi-lateral opening of the handle cover of the umbrella at the head side and bottom side—by means of the resulting revolving slit between handle cover collar and extractable handle at the head side and by means of narrow longitudinal slits in the base plate, which slightly bulges towards the outside at the bottom side.

The advantages, which can be attained by means of the invention, lie in particular in the design of a spatially two-dimensional tripod of the support element, which is fixedly connected to the first tube section of the telescopic tube. On the one hand, the characteristic of the recessed grip within the handle cover does not allow for a fully cross sectional design of the support element. On the other hand, the characteristic of the support element as a tripod allows for free space for air ducts for the ventilated interior handle cover.

A three-point support of the telescopic tube and of the riser, and thus of the umbrella load, is furthermore optimal based on a secured stability on the one hand and on minimal frictional losses between support element and interior wall of the recessed grip in response to the extracting and retracting of the support element, which is fixedly connected to the first tube section of the telescopic tube on the other hand.

A further advantage in the characteristic of the invention lies in the ergonomic embodiment of the handle cover. The oval design of the plastic body nicely fits into the hand of the user and the additional mounting of the recessed grip always provides for clearness in the handling.

According to a further alternative design, the warp-resistant telescopic tube in connection with the riser is formed so as to have a polygonal cross section and also does not allow for twists.

The riser comprising a polygonal cross sectional shape is also connected to the handle cover so as to be stationary and twist-resistant via the appropriately formed riser sleeve.

The collar of the handle cover, which is embodied in a funnel-shaped manner represents an advantageous umbrella retracting aid for the person carrying the umbrella, so as to not cause any injuries to humans and to material even in response to a hasty packing of riser, telescopic tube, slide, canopy rodding and covering by collapsing and/or pushing together into the handle cover. The access possibility for the user to the extractable handle for the purpose of opening the umbrella is furthermore improved. Furthermore, the opening between collar and extractable handle represents an end of the air duct through the handle cover.

BRIEF DESCRIPTION OF THE DRAWING

The subject matter of the invention will be clarified in detail below with reference to the accompanying drawings of exemplary embodiments.

DETAILED DESCRIPTION OF PREFERRED EMBODIMENTS

Figure 1:
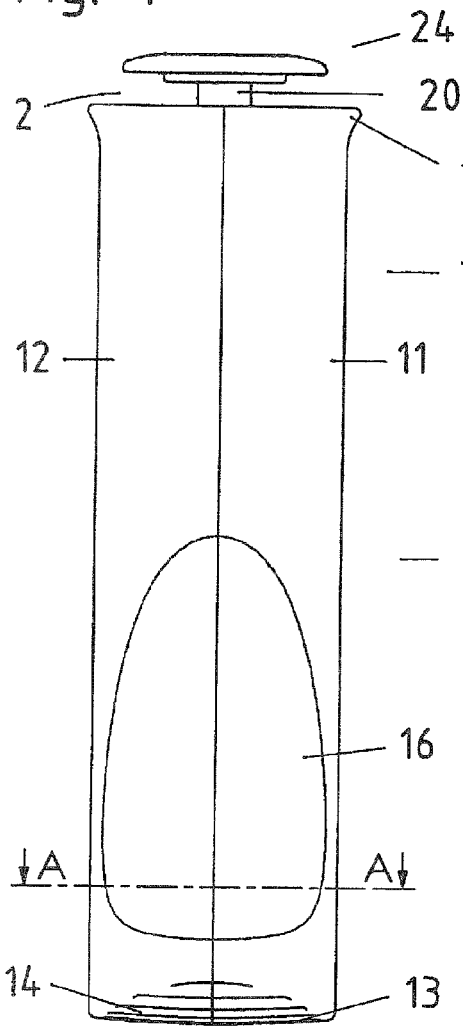
FIG. 1 shows a handle cover comprising a retracted umbrella, front view

Components of the exemplary embodiments, which are the same and which have the same effect, are provided in each case with the same reference numerals in the figures.

The description of the device according to the invention is continued by means of the explanation of the figures.

FIG. 1 shows the handle cover 10 of the compact pocket umbrella 1 comprising retracted umbrella parts in a front view. As can be seen from the figure, the compact pocket umbrella of the inventive novelty substantially consists of an oval-shaped hollow-cylindrical handle cover, being produced preferably in two pieces and connected to one another so as to be fixed and flush, the halves forming a hollow cavity—right handle cover half 11 and left handle cover half 12. The base plate 13, which preferably also slightly bulges towards the outside accommodates the riser sleeve 17 and has ventilation slits 14 for the purpose of ventilating the interior of the handle cover or of the important umbrella parts, such as riser, telescopic tube, slide, canopy rodding and covering, respectively, which are accommodated in the handle cover.

As can further be seen from the figure, the handle cover has a collar 15, which widens slightly towards the outside and which has a plurality of functions. On the one hand, the collar represents a retracting aid, which is useful for the person carrying the umbrella. The collapsed umbrella parts, such as telescopic tube, slide, canopy rodding and covering can be comfortably retracted into the handle cover without damages. On the other hand, the possibility to access the extractable handle 24 by the user is simplified. The extractable handle can be retracted far and can still be easily accessed by the user. The space between collar and extractable handle furthermore forms an end of the duct of the ventilation system 2.

The preferably oval handle cover furthermore has a recessed grip 16, which creates an easy manageability of the umbrella for the user and which also serves as a clearness in the holding direction. Due to the fact that the riser and the telescopic tube are also arranged so as to be twist-resistant, and thus also the rodding and the covering, the position of the umbrella is clear at any given time.

Figure 2:
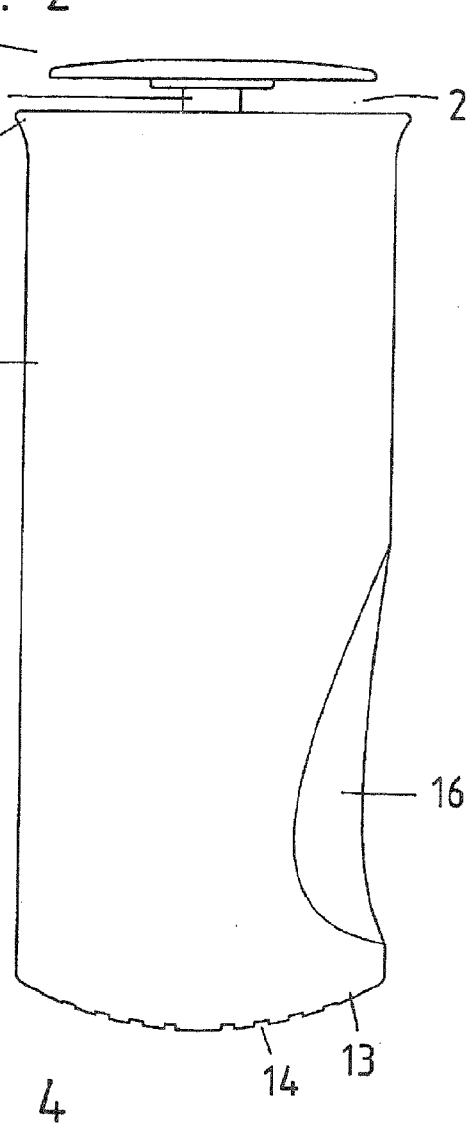
FIG. 2 shows a handle cover comprising a retracted umbrella, side view

FIG. 2 shows a side view of the handle cover 10 comprising retracted umbrella parts in a side view and with a view onto the left handle cover half 12. The characteristic of the base plate 13, which comprises ventilation slits 14 and which preferably bulges towards the outside can as well as the design of the recessed grip 16 can be seen clearly.

Figure 3:
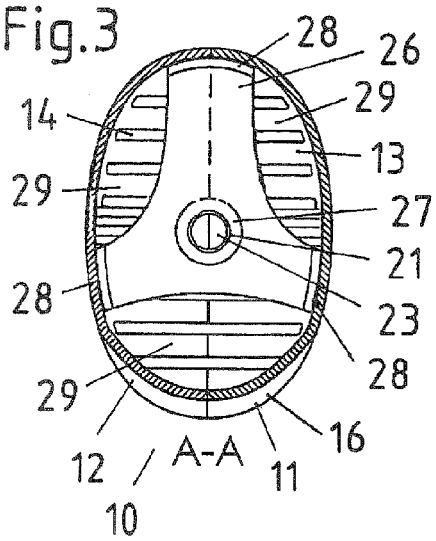
FIG. 3 shows a handle cover, section A-A, simplified, comprising a support element

In FIG. 3, a section A-A from FIG. 1 through the handle cover 10 comprising the two handle cover halves 11 and 12 is illustrated in a simplified manner. By means of a top view, the characteristic of the support element 26 also becomes clear and the embodiment of the ventilation slits 14 of the base plate 13 and of the recessed grip 16 is illustrated.

The support element is preferably shaped as a spatially two-dimensional tripod and is fixedly connected via a tube accommodation 27 to the first tube section 21 of the telescopic tube 20, which can be displaced beyond the riser 23 in its longitudinal direction. A three-point support towards the inner wall of the handle cover 10 by means of the handle cover sliders 28 stabilizes the umbrella parts, such as riser, telescopic tube, slide, canopy rodding and covering.

The embodiment of the support element 26—preferably as a spatially two-dimensional tripod—is chosen in such a manner that the support element passes over a recessed grip 16, which is incorporated into the interior of the handle cover 10, in response to the extraction and retraction of the umbrella parts.

The support element 10 is furthermore preferably characterized in such a manner that a design of air ducts 29 for the ventilation of the interior of the handle cover is possible via air circulation 2 of the base plate 13, which is provided with ventilation slits 14.

Figure 4:
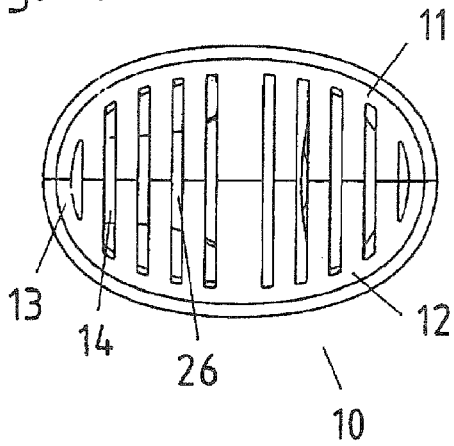
FIG. 4 shows the base plate comprising slits, bottom view, simplified

FIG. 4 shows the base plate 13 of the handle cover 10, which is preferably shaped like an oval, comprising the handle cover halves 11, 12 of the pocket umbrella 1 comprising ventilation slits 14 in a bottom view and in a simplified illustration. The support element 26 is visible through the ventilation slits.

Figure 5:
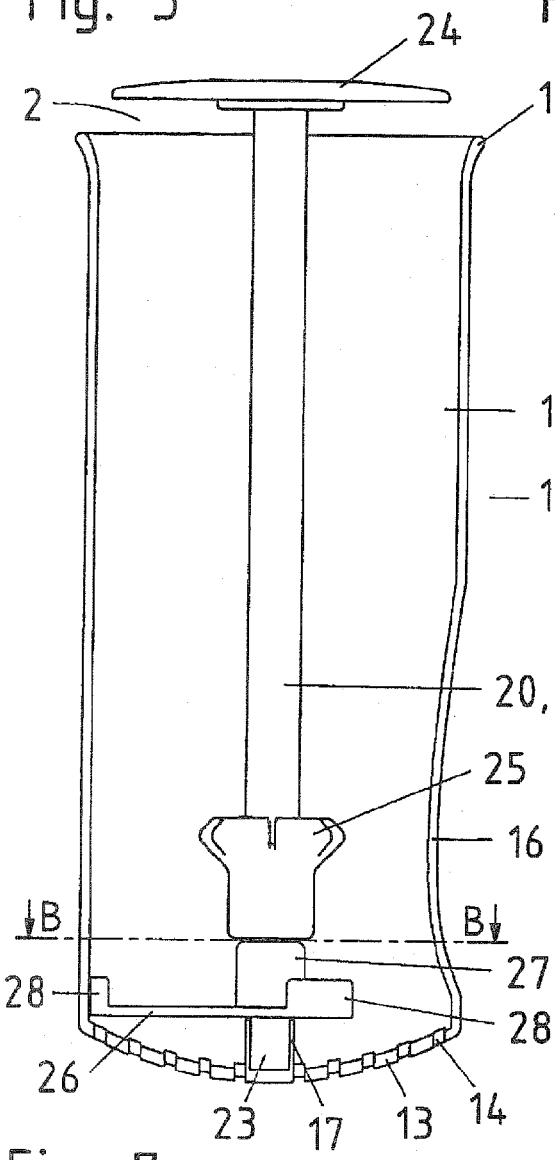
FIG. 5 shows the handle cover comprising a riser/telescopic tube, slide and support element, half of the housing, retracted, simplified

FIG. 5 shows a housing half 11 of the handle cover 10 from the inside comprising a riser sleeve 17, riser 23, telescopic tube 20 or the last tube section 22 of the telescopic tube 20, respectively, support element 26 comprising tube accommodation 27 and handle cover slider 28, slide 25 as well as extractable handle 24 in the retracted umbrella state and in a simplified illustration.

The position of the extractable handle 24, which is also embodied preferably in the shape of an oval, towards the handle cover 10 or the preferably shaped collar characteristic 15 thereof can also clearly be seen in this illustration. The interior ventilation of the pocket umbrella also becomes clear in this context, e.g., air through the ventilation slits 14 of the base plate 13 of the handle cover 10 entering past the support element 26, which is embodied as a tripod and escaping via the ventilation 2 between shaped collar 15 and extractable handle 24.

The outer contour of the handle cover half 11 of the handle cover 10 clearly shows the wall of a preferred position of the recessed grip 16.

Figure 6:
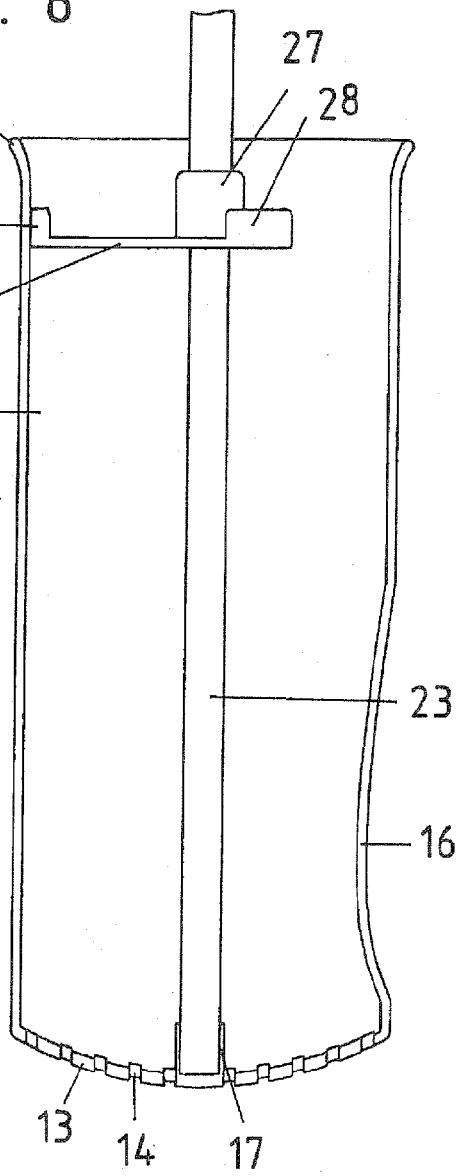
FIG. 6 shows the handle cover comprising a riser/telescopic tube, slide and support element, half of the housing, extended

FIG. 6 follows FIG. 5 in such a manner that the figure shows the handle cover comprising riser sleeve, riser and first tube section of the telescopic tube as well as support element, the telescopic tube comprising canopy rodding and covering in the extracted state.

Figure 7:
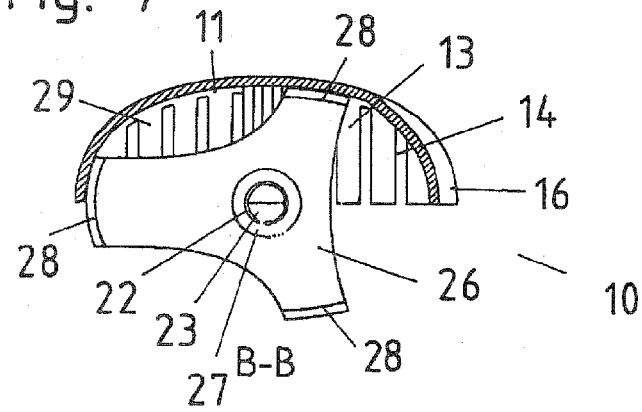
FIG. 7 shows the handle cover, half of the housing, section B-B, comprising a support element.

FIG. 7 illustrates a section B-B from FIG. 5 through a housing half 11 of the handle cover 10 comprising support element 26 in a simplified manner. The characteristic of the support element comprising tube accommodation 27 and handle cover slider 28 also becomes clear thereby and the embodiment of the ventilation slits 14 of the base plate 13 and the recessed grip 16 is illustrated.

Furthermore, the mounting of the support element by means of the tube 20 accommodation to the last, n-th tube section 22 of the telescopic tube is illustrated, which is arranged so as to be displaceable above the riser 23. The embodiment of the support element as a tripod comprising a three-point support allows for the arrangement of a recessed grip in the handle cover on the one hand and for the formation of ventilation ducts 29 for the air circulation of the interior of the handle cover on the other hand.

Advantageous further developments of the invention are the object of the dependent claims. The numerous possibilities and advantages of the embodiment of the invention are represented in the number of the claims.

What is claimed is:

1. A collapsible umbrella, comprising:

a telescopic tube having telescoping tube sections;

a handle cover having an oval cross section and provided with a recessed grip extending inward;

an elongated riser arranged within the handle cover; and a support, arranged inside the handle cover, for stabilization of the umbrella, said support including a tube accommodation and a support element, the support element fixed to the tube accommodation and being fixedly connected to a first one of the tube sections via the tube accommodation, and the support element being shaped as a spatially two-dimensional tripod to be configured to allow passing over the recessed grip; and wherein, the support moves along the elongated riser between a lower position when the umbrella is in a retracted position inside of the handle cover, and an upper position to move the umbrella upward when the umbrella is in an extended position.

2. The umbrella of claim 1, wherein the support element is supported in the handle cover between the telescopic tube and an inner wall of the handle cover, and configured to allow the recessed grip to extend inwards into the handle cover and to be passed over by the support element.

3. The umbrella of claim 1, further comprising the elongated riser extending in prolongation of the telescopic tube and a riser sleeve to fixedly connect the riser to a base plate of the handle cover, wherein the support element is constructed to permit a three-point support of the riser and of the telescopic tube, which is arranged so as to be displaceable with the riser by handle cover sliders in relation to a hollow-cylindrical inner wall of the handle cover.

4. The umbrella of claim 1, wherein the support element is constructed in a spatially two-dimensional manner and with n-legs, wherein n is the number of legs, with n>3.

5. The umbrella of claim 3, wherein the base plate is formed with ventilation slits which are open to the outside, said support element being constructed to define air ducts in communication with the ventilation slits to ventilate an interior of the handle cover through circulation of air.

6. The umbrella of claim 1, wherein the handle cover includes towards a removal and ventilation side of the umbrella an outwardly widening collar in the shape of a funnel for access to an extractable handle.

7. The umbrella of claim 1, wherein the recessed grip is incorporated in the handle cover.

8. The umbrella of claim 3, wherein the handle cover is sized sufficient to cover the riser, telescopic tube, a slide, a canopy rodding and a covering, when the umbrella is collapsed and/or pushed together.

9. The umbrella of claim 1, further comprising an extractable handle constructed in radial direction to form a fixedly connected closure of the telescopic tube and having an oval cross section.

10. The umbrella of claim 3, wherein the riser is mounted in the riser sleeve so as to be twist-resistant.

11. The umbrella of claim 3, wherein the riser and the telescopic tube are arranged above one another and slidably joined together so as to be twist-resistant.

12. The umbrella of claim 3, wherein the riser and the first one of the tube sections are slidably joined together so as to be twist-resistant.

13. The umbrella of claim 1, wherein the tube sections are slidably joined together so as to be twist-resistant.

* * * * *